United States Patent [19]

Hozumi et al.

[11] Patent Number: 4,889,164

[45] Date of Patent: Dec. 26, 1989

[54] SOLENOID CONTROLLED VALVE

[75] Inventors: Kazuhiro Hozumi; Masaru Arai, both of Chiba; Yoshitane Saito, Kyoto, all of Japan

[73] Assignees: Kuroda Seiko Company Limited; Nakamura Kiki Engineering Company Limited, both of Japan

[21] Appl. No.: 208,771

[22] Filed: Jun. 20, 1988

[30] Foreign Application Priority Data

Jul. 3, 1987 [JP] Japan ..... 62-102883

[51] Int. Cl.[4] ..... F15B 13/043; F15B 13/08

[52] U.S. Cl. ..... 137/625.64; 137/596.16; 137/884

[58] Field of Search ..... 137/596.16, 625.64, 137/884

[56] References Cited

U.S. PATENT DOCUMENTS

| | | | |
|---|---|---|---|
| 3,111,139 | 11/1963 | Beckett et al. | 137/884 |
| 3,215,158 | 11/1965 | Bass et al. | 137/596.16 X |
| 3,323,547 | 6/1967 | Van Husen | 137/625.64 |
| 3,513,876 | 5/1970 | Tarbox | 137/596 |
| 3,688,797 | 9/1972 | Sorenson | 137/625.64 |

FOREIGN PATENT DOCUMENTS

| | | | |
|---|---|---|---|
| 160477 | 12/1981 | Japan | 137/625.64 |
| 104876 | 6/1985 | Japan | 137/884 |
| 143284 | 7/1985 | Japan | 137/884 |
| 61-124776 | 8/1986 | Japan . | |
| 61-126162 | 8/1986 | Japan . | |
| 61-126163 | 8/1986 | Japan . | |

*Primary Examiner*—Gerald A. Michalsky

*Attorney, Agent, or Firm*—Peter J. Georges

[57] ABSTRACT

A solenoid controlled valve of the double pilot type includes a valve main body having a valve mechanism, a pair of pilot valve units each being secured to respective sides of the valve main body and having solenoids for driving the valve mechanism of the valve main body, to first and second sets of male terminals connected to the solenoids, a wiring box being secured to a lower surface of an assembly of the valve main body and the pilot valve units, third and fourth sets of female terminals receiving the first and second sets of male terminals, respectively, a fifth set of male terminals connected to the third and fourth sets of terminals via electric wires, and a base secured to a lower surface of the wiring box at its center. The wiring box has formed therein conduits which are communicated with conduits formed in the valve main body and the base.

6 Claims, 3 Drawing Sheets

SOLENOID CONTROLLED VALVE

BACKGROUND OF THE INVENTION

1. Field of the Invention

The present invention relates generally to a solenoid controlled valve, i.e. a electromagnetic valve for use in various kinds of industrial machines utilizing pressure such as oil pressure and air pressure, and more particularly to a solenoid controlled valve of the double pilot type in which a pair of pilot valve units including solenoids are provided on respective sides of a valve main body including a valve mechanism driven by the solenoids.

2. Description of the Related Art

The above mentioned double pilot type solenoid controlled valve has been widely used. In a known solenoid controlled valve, electric wires for supplying driving signals to the solenoids provided in the pilot valve units are separately connected to the pilot valve units. Therefore, in the case of mounting a plurality of valves on a single common manifold, a number of electric wires have to be connected to respective pilot valve units, so that the wire connecting operation is very cumbersome.

In order to make easier the wire connecting operation, Japanese Utility Model Publication, No. 61-126162 proposed therein a solenoid controlled valve in which electric wires can be connected to the valve only from one side thereof. That is to say, a printed circuit board is inserted between a valve main body and a base and one side thereof is extended beyond one pilot valve unit, the electric wires being connected to the extended portion. However, in this known valve, the projected portion of the printed circuit board might be subjected to dust, water, and mechanical stress. These intrusions result in deterioration of the electric connection so that a malfunction of the valve might occur. This drawback would be significant when an electric circuitry for controlling and protecting the valve is arranged on the exposed portion of the printed circuit board as disclosed in Japanese Utility Model Publication, No. 61-124776.

In Japanese Utility Model Publication, No. 61-126163, a printed circuit board is arranged on a top surface of the valve and a cover is provided on the printed circuit board. In this known valve, it is necessary to provide a substantially large space for arranging a connector for the electric wires and thus the whole dimension becomes very large and the cost is liable to increase.

SUMMARY OF THE INVENTION

The present invention has for its object the provision of solenoid controlled valve of the double pilot type in which electric wires can be connected to the valve from its one side without using the printed circuit board so that better electric connection can be attained and a malfunction of the valve can be prevented, and further the valve can be made small in size and cheap in cost.

According to the invention, a solenoid control valve of the double pilot type includes a valve main body having a valve mechanism installed therein and conduits connected to the valve mechanism, a pair of pilot valve units each being secured to respective sides of the valve main body and having solenoids for driving the valve mechanism in the valve main body, and a base arranged underneath the valve main body and having conduits. The improvement comprises first and second sets of terminals each being provided on lower surfaces of the respective pilot valve units and being connected to the respective solenoids, a wiring box being secured to lower surfaces of the valve main body and the pilot valve units and having third and fourth sets of terminals provided on an upper surface of the wiring box at such positions that the third and fourth sets of terminals are connected to the first and second sets of terminals, respectively, a fifth set of terminals provided on a lower surface of the wiring box and electric wires connected between the third and fourth sets of terminals and the fifth set of terminals, and conduits communicated with said conduits formed in said valve main body and the base.

DETAILED DESCRIPTION OF THE PREFERRED EMBODIMENTS

Figure 1:
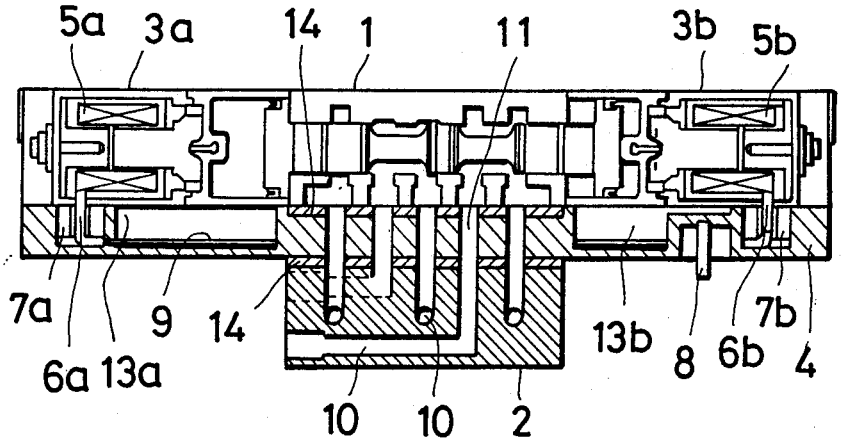
FIG. 1 is a cross sectional view showing an embodiment of the solenoid controlled valve according to the invention.

FIG. 1 is a cross-sectional view showing an embodiment of the solenoid controlled valve of a double pilot type according to the invention. The valve comprises a valve main body 1, a base 2, and a pair of pilot valve units 3*a* and 3*b*. The pilot valve units 3*a* and 3*b* are secured to respective sides of the valve main body 1. The valve further comprises a wiring box 4 which is arranged between the valve main body 1 and the base 2. A length and a width of the wiring box 4 are equal to those of an assembly of the valve main body 1 and the pilot valve units 3*a*, 3*b*. In the pilot valve units 3*a* and 3*b*, there are arranged electromagnetic coils or solenoids 5*a* and 5*b* which are connected to first and second sets of male terminals 6*a* and 6*b*, respectively. On an upper surface of the wiring box 4, there are provided third and fourth sets of female terminals 7*a* and 7*b*. On a lower surface of the wiring box 4, there is arranged a fifth set of male terminals 8. The first and second sets of male terminals 6*a* and 6*b* are inserted into the third and fourth sets of female terminals 7*a* and 7*b*, respectively, when the wiring box 4 is secured to the assembly of the valve main body 1 and the pilot valve units 3*a* and 3*b*. It should be noted that the female terminals 7*a* and 7*b* are connected via electric wires 9 arranged within the wiring box 4 to the male terminals 8.

In the valve main body 1, there is arranged a valve mechanism which is driven by the solenoids 5*a* and 5*b*. In the base 2 there are formed conduits 10. In the wiring box 4, there are formed holes 11 there through which are communicated with conduits formed in the valve main body 1 and the conduits 10 formed in the base 2. It should be noted that the electric wires are extended within the wiring box 4 through portions where the holes 11 are not formed. Between the valve main body 1 and the wiring box 4 and between the wiring box 4 and the base 2, there are arranged packing sheets 14 in order to prevent the fluid from leaking out of the valve.

Figure 2:
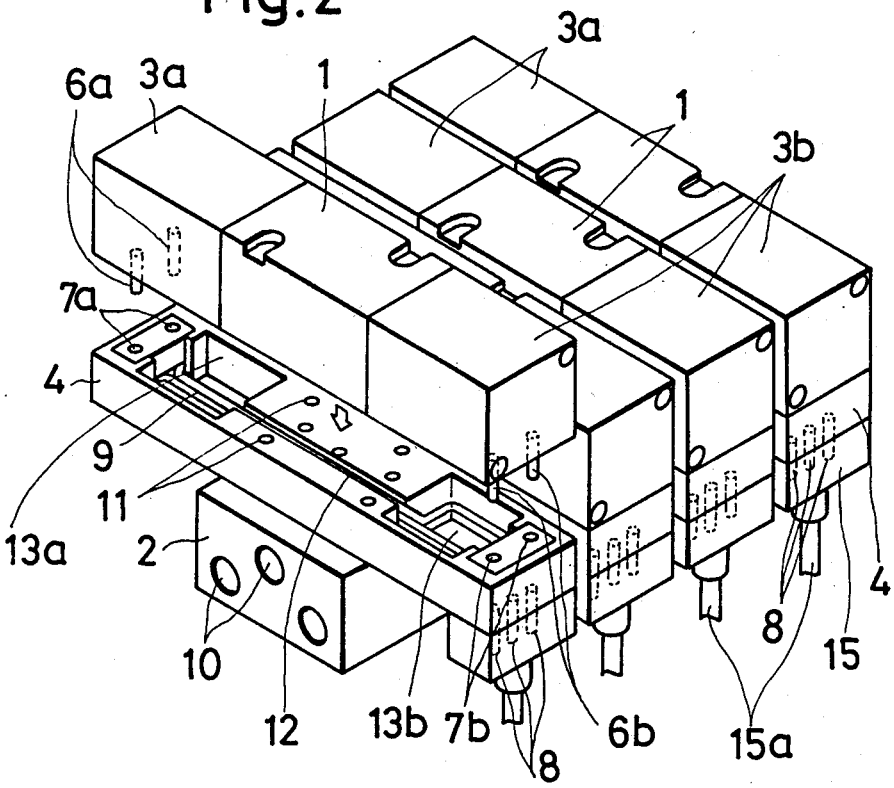
FIG. 2 is a partially exploded perspective view thereof.

FIG. 2 is a perspective view showing another embodiment of the solenoid controlled valve according to the invention. In the present embodiment, a plurality of the valves shown in FIG. 1 are mounted on a single elongated manifold base 2 in parallel with each other. It should be noted that the wiring boxes 4 are arranged such that the male terminals 8 situate on one side of the valve assembly. Electric wires 15 a are connected to the fifth set of male terminals 8.

Figure 3:
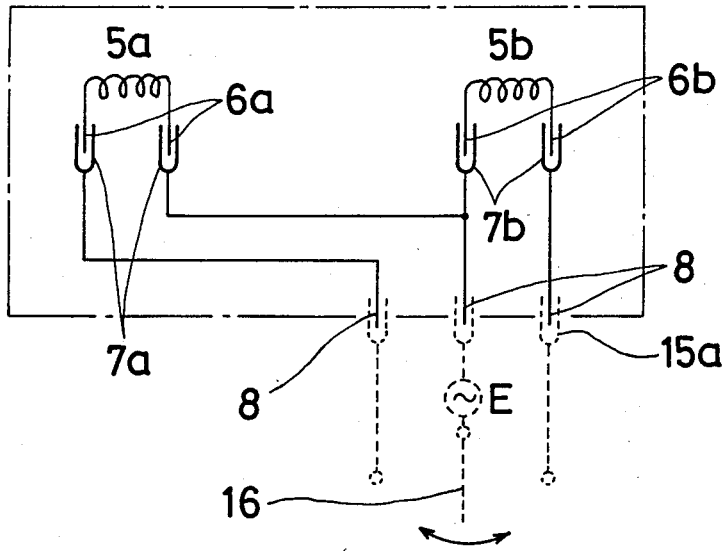
FIG. 3 is a circuit diagram illustrating an electric connection of the valve.

FIG. 3 is a circuit diagram showing the electric connection of the solenoids 5*a* and 5*b* with male terminals 6*a*, 6*b* and 8 and female terminals 7*a* and 7*b*. The electric wires 15*a* are connectable to a power source E through a switch 16. When the switch 16 is operated, the solenoids 5*a* and 5*b* are alternately connected to the power source E.

Figure 4:
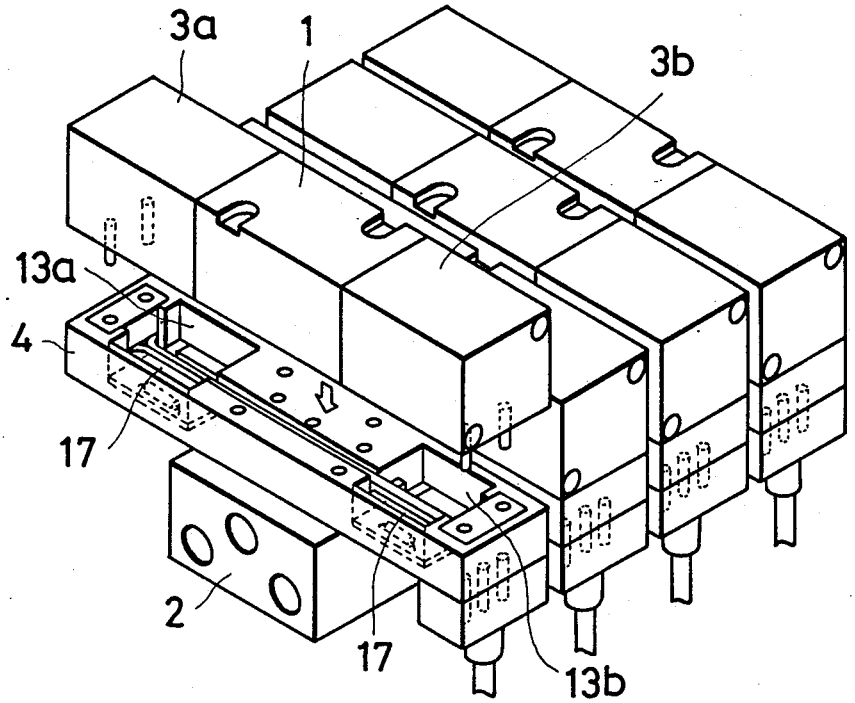
FIG. 4 is a partially exploded perspective view depicting another embodiment of the valve according to the invention.

FIG. 4 is a perspective view showing another embodiment of the solenoid controlled valve according to the invention. In the present embodiment, electric circuitries 17, such as valve control circuit and protection circuits for overvoltage and overcurrent, are provided in spaces 13*a* and 13*b* formed in the wiring box 4.

Figure 5:
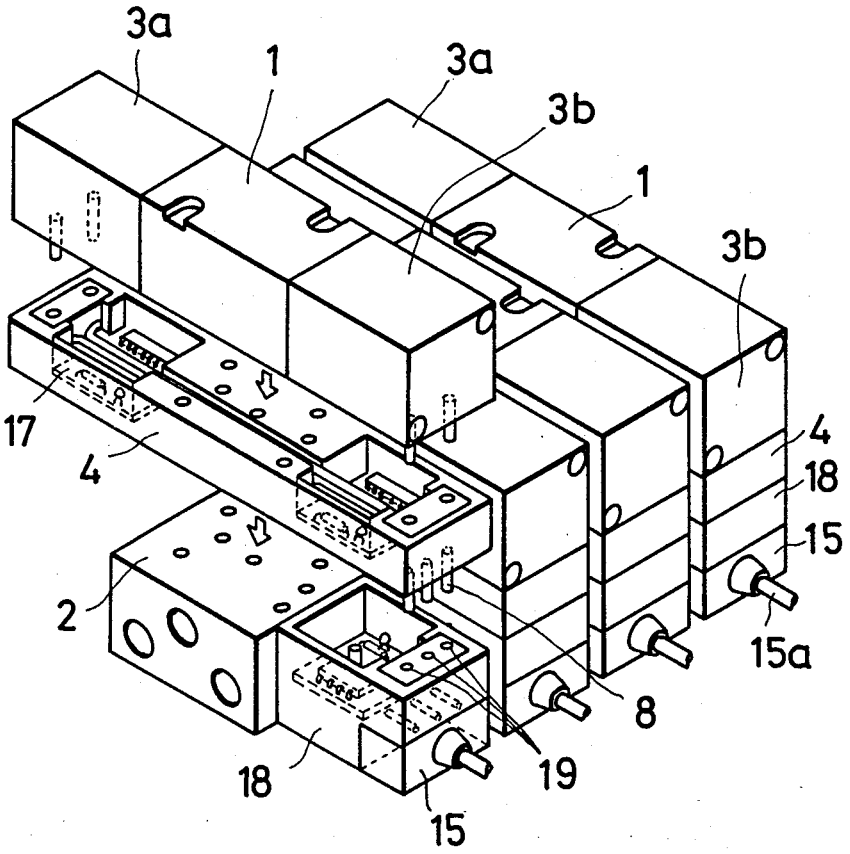
FIG. 5 is a partially exploded perspective view showing still another embodiment of the valve according to the invention.

FIG. 5 is a perspective view illustrating still another embodiment of the solenoid controlled valve according to the invention. In the present embodiment, packages 18 having driver circuits installed therein are connected to the wiring boxes 4. That is to say, the fifth set of male terminals 8 provided on the lower surface of the wiring box 4 are inserted into female terminals 19 provided on the upper surfaces of packages 18. The packages 15 are aligned on one side of the base 2 so that the operation of arranging the packages 15 and 18 becomes very simple and the packages 15 and 18 effectively protected from dust, water, and stress.

As shown in Figs.4 and 5, necessary circuits 17 can be installed in the spaces 13*a* and 13*b* in the wiring box 4, and the packages 18 having the necessary circuits installed therein can be secured to the wiring box 4 on one side of the base 2.

As explained above in detail, in the solenoid controlled valve according to the invention, the electric wires 15*a* and circuitries 17 are hermetically sealed in the space 13*a* and 13*b* between the valve main body 1, pilot valve units 3*a* and 3*b*, and wiring box 4 so that the electric wires 15*a* and circuitries 17 are effectively protected from dust, water, and mechanical stress. Therefore, the electric wires 15*a* can be prevented from being damaged and broken and a malfunction of the valve can be effectively prevented. Further, the dimension of the wiring box 4 is made equal to that of the assembly of the valve main body 1 and pilot valve units 3*a* and 3*b*. Thus the longitudinal dimension of the valve is not increased and the whole valve can be made small in size. Since the upper opening of wiring box 4 is closed by the valve main body 1 and the pilot valve units 3*a* and 3*b* are arranged on both sides thereof, it is not necessary to provide a separate cover for the wiring box 4, and the valve can be manufactured inexpensively. Moreover, the circuitries 17 can be arranged in the spaces 13*a* and 13*b* formed in the wiring boxes 4 or in packages 15 and 18 which are secured to the wiring boxes 4, so that the whole dimension of the valve is not increased.

What is claimed is:

1. A solenoid controlled valve of a double pilot type including a valve main body having a valve mechanism installed therein and conduits connected to the valve mechanism, a pair of pilot valve units each being secured to respective sides of the valve main body, solenoids for driving the valve mechanism in the valve main body, and a base arranged underneath the valve main body and having conduits, the improvement comprising:

first and second sets of terminals each being provided on lower surfaces of the respective pilot valve units and each being connected to the respective solenoids, a wiring box being secured to lower surfaces of the valve main body and the pilot valve units, wherein said wiring box has a space formed therein and an electric circuitry is inserted in said space, third and fourth sets of terminals provided on an upper surface of the wiring box at such positions that the third and fourth sets of terminals are connected to said first and second sets of terminals, respectively, a fifth set of terminals provided on a lower surface of the wiring box, electric wires connected between said third and fourth sets of terminals and said fifth set of terminals, and conduits communicated with said conduits formed in said valve main body and said base.

2. A valve according to claim 1, wherein said first and second sets of terminals are formed by male terminals, said third and fourth sets of terminals are formed by female terminals, and said fifth set of terminals is formed by male terminals.

3. A valve according to claim 2, wherein said wiring box has a length and a width which are equal to a length and a width of an assembly of the valve main body and the pilot valve units.

4. A valve according to claim 3, wherein the valve further comprises a package arranged underneath the wiring box on one side of the base and an electric circuitry is installed in the package.

5. A valve according to claim 1, wherein between said wiring box and the valve main body and the base are inserted packing sheets.

6. A valve according to claim 1, wherein said base is formed as an elongated manifold and a plurality of assemblies of a valve main body, a pair of pilot valve units, and a wiring box are arranged on the base side by side.

* * * * *